United States Patent [19]

Schmitz

[11] Patent Number: 4,505,082

[45] Date of Patent: Mar. 19, 1985

[54] STRUCTURAL PANEL

[76] Inventor: Peter Schmitz, Bahnhofstrasse 3, D-4401 Altenberge, Fed. Rep. of Germany

[21] Appl. No.: 347,373

[22] Filed: Feb. 10, 1982

[51] Int. Cl.[3] ..... E04C 2/26

[52] U.S. Cl. ..... 52/309.8; 52/405; 52/782

[58] Field of Search ..... 52/309.8, 309.9, 309.11, 52/528, 530, 536, 515, 404, 593, 578, 588, 405, 782, 785, 602, 802, 805, 821, 822; 428/71, 76, 54–60, 319.1, 659; 29/521

[56] References Cited

U.S. PATENT DOCUMENTS

| | | | |
|---|---|---|---|
| 114,733 | 5/1871 | Wands | 52/530 |
| 403,444 | 5/1889 | Patten | 52/530 |
| 425,002 | 4/1890 | Sagendorph | 52/528 |
| 503,941 | 8/1893 | Brooks | 52/530 |
| 697,956 | 4/1902 | Thompson | 29/521 |
| 764,219 | 7/1904 | Volp | 52/227 |
| 1,570,720 | 1/1926 | Baker | 52/405 |
| 2,047,154 | 7/1936 | Pimsner | 52/404 |
| 2,284,229 | 5/1942 | Palmer | 52/578 |
| 2,682,938 | 7/1954 | MacDonald | 52/404 |
| 2,891,638 | 6/1959 | Grundy . | |
| 2,896,271 | 7/1959 | Kloote et al. | 52/309.9 |
| 3,062,337 | 11/1962 | Zittle | 52/404 |
| 3,303,619 | 2/1967 | Janecek | 52/528 |
| 3,318,060 | 5/1967 | Collins | 52/515 |
| 3,327,447 | 6/1967 | Nissley | 52/593 |
| 3,363,391 | 1/1968 | Bordenave | 52/578 |
| 3,535,844 | 10/1970 | Glaros | 52/309.9 |
| 3,555,758 | 1/1971 | Schroter | 52/309.9 |
| 3,715,846 | 2/1973 | Sullhofer | 52/309.9 |
| 3,760,548 | 9/1973 | Sauer et al. | 52/309.11 |
| 4,037,377 | 7/1977 | Howell et al. | 52/309.9 |
| 4,070,513 | 1/1978 | Rhoads | 428/57 |
| 4,237,192 | 12/1980 | Ito et al. | 428/659 |

FOREIGN PATENT DOCUMENTS

| | | | |
|---|---|---|---|
| 1053306 | 12/1966 | United Kingdom | 52/785 |

*Primary Examiner*—James L. Ridgill, Jr.

*Attorney, Agent, or Firm*—Lockwood, Alex, FitzGibbon & Cummings

[57] ABSTRACT

A platelike structural panel is disclosed having spaced surfaces with a foamed core material therebetween. The surfaces are formed of sheet metal plates having adjacent longitudinal edges which are bent so as to form grooved seams joining and locking the plates together. The surfaces may be formed by continuously joining and seaming sheet metal from a coil and the foamed core may be formed by foaming the material between the joined plates or by gluing already foamed material between the plates.

14 Claims, 5 Drawing Figures

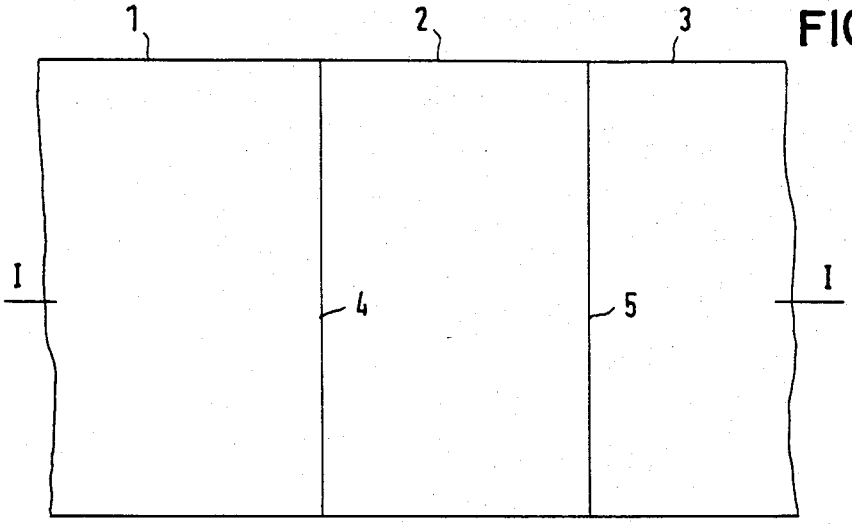
FIG. 1
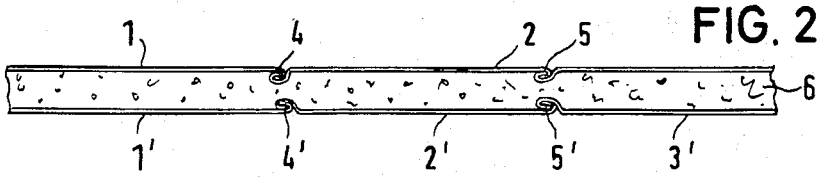
FIG. 2
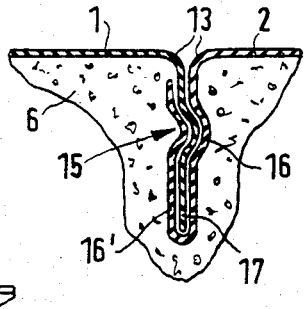
FIG. 5
FIG. 3
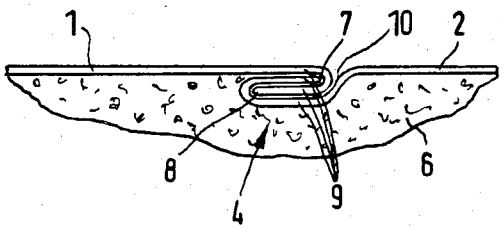
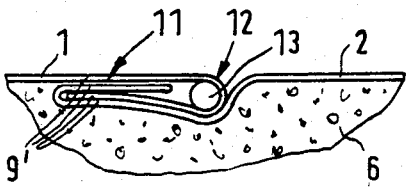
FIG. 4

STRUCTURAL PANEL

BACKGROUND & SUMMARY OF THE INVENTION

The present invention relates a platelike structural element with outer surfaces of sheet metal plates, such as sheet steel plates, with a foamed material core between the plates, the latter of which is tightly formed to turned surfaces of the plates.

In many construction uses, platelike or slab-like structural elements or panels have been used advantageously, providing they exhibit certain qualities. Various plates of wood or plastic glued shavings, such as chip board or gypsum plaster board, or other slab-like structural elements of organic or inorganic materials have been considered in such construction uses. Such materials cannot always be employed, however, because of their mechanical strength, their combustibility or their low durability to water or dampness.

Structural elements in platelike or slab-like configuration are advantageous where the elements not only have the largest possible area, but are also relatively lightweight and exhibit the necessary mechanical strength, are nonflammable or at least ignite with difficulty, can withstand environmental effects for a long period of time, and exhibit sufficient corrosion resistance.

Such platelike or slab-like structural elements have been usable in building as well as vehicle construction and also in interior furnishings of ships and other vessels.

A problem of the present invention is to produce such a slab-like structural element or panel that has such universal use capability.

This problem is resolved in the structural element incorporating the principles of the present invention wherein at least two sheet steel plates cover the foamed material core and lie next to each other and are seamed together at their edges. Because of this, a platelike or slab-like structural element or panel results of practically any desired length and width. The surfaces of the element of panel are formed of at least two sheet plates positioned next to each other, between which is a foamed material core that is tightly joined to turned surfaces of the sheet steel plates, either in the process of the foaming of the foamed material core between the plates or by gluing or attachment with other suitable adhesives.

The plates preferably are formed of 0.5 mm thick sheet steel, also called body sheet, which can be superficially heat treated and primed.

One such platelike structural element or panel is suitable for the various uses. For most uses such element has adequate strength and a durable, corrosion-resistant surface that is essentially free of joints and seams. A shallow crease only exists in the area of the grooved seam of the two adjacent plates.

Although the sheet metal plates of the present invention could be formed of aluminum having a wide variety of widths, aluminum does have certain disadvantages with respect to its strength and its cost. Thus, sheet steel is preferred for the metal plates of the present invention.

Where the sheet metal to be employed in the element or panel of the present invention is thin, it is frequently only available in narrow widths. The edges of several of such narrow plates could be joined together through a single shear-riveted joint joined by means of grooves.

However, the riveted plate edges result in metal which is exposed to the environment which can lead to corrosion. Thus, additional protective measures must be taken with such joints.

In the preferred embodiment of structural element or panel incorporating the principles of the present invention, the plates are joined or seamed at grooves and have the advantage that the cut edge of the plates is imbedded in the groove and is protected by bent back plate layers. The surfaces of both joined plates are thereby contiguous and the groove is sealed externally. In this way, structural elements or panels incorporating the principles of the present invention can be produced in practically in any size, so long as they are still manageable.

Moreover, one or the other plate can also be provided, before the grooving, with a superficial structure or change of form, e.g. with an incorporated slit or crease. The production of the latter form of structural element or panel is preferably continuous, such as from at least two sheet metal coils provided for the upper and lower layers or surfaces. The plate may be continually removed from the coils, transported to corresponding grooving equipment, and seamed together so as to be receptive to a further operation in which the foamed material that forms the core and that joins both sheet metal layers with each other can be positioned between the seamed plates. These structural elements or panels can then be cut to certain desired dimensions and be transported for further processing.

In one principal aspect of the present invention, a platelike structural panel includes first and second surfaces spaced from each other with a core of foamed material therebetween. Each of the surfaces comprises at least a pair of longitudinally extending sheet steel plates each of which has a longitudinal edge extending adjacent the longitudinal edge of the next adjacent plate, and grooved seam means is formed from these edges joining and locking the adjacent plates along their longitudinal edges.

These and other objects, features and advantages of the present invention will become apparent upon consideration of the following detailed description.

BRIEF DESCRIPTION OF THE DRAWING

In the course of this description, the drawing will frequently be referred to in which:

FIG. 1 is a plan view of a preferred embodiment of structural element or panel incorporating the principles of the present invention in which three plates are joined together;

FIG. 2 is a cross-sectioned side elevational view of the element or panel as viewed substantially along line I—I in FIG. 1;

FIG. 3 is an enlarged view of one of the plate junctions or seams shown in FIG. 2;

FIG. 4 is an enlarged view of another preferred embodiment of plate junction or seam incorporating the principles of the present invention; and FIG. 5 is an enlarged view of still another preferred embodiment of plate junction or seam incorporating the principles of the present invention.

DESCRIPTION OF THE PREFERRED EMBODIMENTS

Prior to discussing the structural elements or panels incorporating the principles of the present invention, it should be noted that the machinery for the production of such structural elements or panels is not the subject of the present invention. Any suitable machine may be employed which produces grooves to be formed from a thin sheet metal coil of sheet metal plate of about 0.5 mm thickness and such that the plate edges are brought together so that they may be formed in a suitable rolling mill and seamed together.

Such forming is generally known and, preferably, results not only in seaming of the plates for the upper plate layer of the structural element or panel, but also results in the plates for the lower plate layer being simultaneously and continuously pulled from sheet metal coiled and seamed together with the upper plates, and the foamed material core may be positioned in between the plates.

The positioning of the foamed material core between the plates can be such that the foam, in the form of a certain formula, such as a polyurethane, can be injected or otherwise admitted between the plates and developed to a foam there so that the foam develops toward the turned surfaces of the plates, presses against the plates and tightly contacts them.

The corresponding surfaces of the plates can, thereby, be prepared shortly before the introduction of the foam forming material so that there is a good and complete surface connection with the foamed material.

It is also possible to form such platelike structural elements or panels of finite pieces of sheet metal that are seamed together, if that should be necessary for some reason. Primarily for economy of production costs, the continual production from the coil is preferred, however.

As soon as the preferred structural element or panel incorporating the principles of the present invention is formed, it is cut to certain desired measurements transverse to its grooved seams.

A preferred structural element or panel incorporating the principles of the present invention is shown in FIG. 1. The panel comprises three plate sections 1, 2, and 3 forming the upper surfaces of the panel and these plate sections are joined together by grooved seams 4 and 5.

These grooved seams 4 and 5 are shown in more detail in FIG. 2, which is a cross section of the structural element shown in FIG. 1, the section being exaggerated in size for purposes of illustration.

From FIG. 2 it will be seen that the grooved seams for the upper or first and lower or second sheets are placed vertically relative to each other. Those of the lower layer are denoted 4' and 5', while the section plates are identified as 1', 2', and 3'. The foamed material core 6 is also shown. It will be understood, however, that the grooved seams need not lie directly under each other, but they may be staggered relative to each other, for example, at a half width of each of the plate sections. Such staggering can be of advantage in some end uses.

One of the grooved seams 4 of FIGS. 1 and 2 is shown in further enlarged detail in FIG. 3. The left plate section 1 and right plate section 2 are also shown. Grooved seam 4 is imbedded in the foamed material core 6 of which part is also shown.

In FIG. 3, it can also be seen that the cut edge 7 of plate 2 and edge 8 of plate 1 are covered at all angles by the bent back plate edge strips and that there is surface contact between these four layers or strip portions at 9. Only a shallow V-shaped groove 10 faces outwardly. Groove 10 has curved edges. This groove, with further processing of the plate, might be smoothed or filled by the addition of more coats of paint or superficial coats to the plates 1 and 2 so that the structural element or panel has a homogeneous superficial appearance.

The surfaces of the plates may be heat treated, primed, or similarly treated, so that the groove 10 may be practically sealed when the various plate edges are pressed together so that the cut edges 7 and 8 are protected.

Moreover, the foamed core material 6 also imbeds the underside of the seam from every angle and its strip portions and renders it liquid and gas-proof, so that, contrary to rivet seams, there is excellent protection for the grooved seam.

The large surfaced platelike structural element or panel of the present invention can be employed extensively in a wide range of uses. It may be used where previously surfaces or components had to be constructed of many small slab or block-shaped elements.

The formula for the generation of the foamed material for the core 6 of the structural element or panel and for the foamed material itself, in case it is joined to the plates by gluing or other adhesive, is preferably selected so that the foamed material itself contributes to the strength of the structural element as a construction panel. Such foam material is within the selection of those skilled in the art after they have considered the disclosure herein. In view of this, it is possible to use relatively thin sheet steel.

It is desirable to avoid cracking in the superficially heat treated plates, which may be, for example zinc or lacquer coats, due to sharp bending back of the plate strips in the area of the seam. Such cracks can result in corrosion and all of the disadvantages arising therefrom. In the embodiment shown in FIG. 4, the bending of the edge strip of the outer plate 1 has a proportionately large sweep so that the bending is substantially tear-shaped in cross section. The bending of the other plate 2 to be seamed to form its strip portions can be bent more sharply, because it is inside of the panel and is also imbedded in the foamed material.

Such large radius bend 12 can, if desired, be filled with a longitudinally extending flexible substantially cylindrical filler, for example a plastic wire 13. The locking of the seam lies further inward, as shown at 9', where the plate edge strips and the portions thereof are tightly pressed against each other.

In the shaping of this seam, the bent plate edge strip is preferably broader than in the shaping of the seam shown in FIG. 3.

A third embodiment of grooved seam is shown in FIG. 5. The seam shaping in this embodiment is also espcially advantageous and is simple and efficient to produce.

This seam differs from the previously described seams in that the bent plate edge strips that are touching each other are first at approximately right angles to the plane of the plates 1 and 2. The one plate 1 only has a single bent back edge portion almost at right angles, while the other plate 2 is bent back over a large area at right angles, and about half of this bent edge strip is further bent outwards in a U-shape to define a pair of strip portions. The single bent back edge strip portion of plate 1 is marked 17, and the U-shaped bent back edge strips of plate 2 are marked 16 and 16'.

A feature in the grooved seam shown in FIG. 5 is that the three interrelated strip portions 16, 16' and 17 are additionally stamped, at regular intervals so that circular impressions or irregularities 15 are formed. By these circular, interlocking cup-shaped impressions 15, all three strip portions 16, 16' and 17 are correspondingly changed in form, so that there is a further interlocking seaming action apart from the seaming caused by adherence of the strip portions 16, 16' and 17 with each other giving additional strength to the seam. The seam which now projects into the foam core 6 is ribbed on the inside surfaces, and thereby lends additional stiffness and strength to the structural element or panel.

The bending back of both plates 1 and 2 at 13 is again also performed so that no damage occurs to the superficial coatings, such as tears or hairline cracks.

It will be understood that the embodiments of the present invention which have been described are merely illustrative of a few of the applications of the principles of the invention. Numerous modifications may be made by those skilled in the art without deparating from the true spirit and scope of the invention.

What I claim is:

1. A platelike structural panel comprising a first continuously formed sheet and a second continuously formed sheet spaced from said first sheet with a core of foamed material therebetween joined to the surfaces of said sheets adjacent the foamed material so as to strengthen said panel, each said sheet comprising at least a pair of longitudinally extending sheet metal plates, each of said plates having a longitudinal edge extending adjacent the longitudinal edge of the next adjacent plate, each of the lonitudinal adjacent edges being folded to define a pair of continuously formed strips at the longitudinal adjacent edges, said pair of strips together defining a total of at least three continuously bent strip portions, said three strip portions being positioned in overlying, directly contacting relationship with each other and continuously joining and locking said adjacent plates together along their said longitudinal edges to form a grooved seam, said seam defining a shallow crease between the surfaces of adjacent plates of said first and second sheets opposite said foamed material whereby said adjacent plate surfaces are contiguous to each other, said overlying, directly contacting strip portions of both said first and second sheets being positioned in the space between said sheets so as to extend into and be embedded in said foamed material in the space, said core of foamed material extending continuously across said overlying locked strip portions and between the plates of said first and second continuously formed sheets, and said first and second continuously formed sheets and said core are cut transversely of said seam to define said panel.

2. The panel of claim 1 wherein said foamed material is foamed between said seamed plates.

3. The panel of claim 1 wherein said foamed material is adhesively bonded to the sides of said plates which face each other.

4. The panel of claim 1 wherein said foamed core contributes substantially to the strength of said panel.

5. The panel of claim 1 wherein said overlying portion are substantially vertically aligned with each other.

6. The panel of claim 1 wherein said foamed material is polyurethane.

7. The panel of claim 1 wherein at least one of said sheets is treated.

8. The panel of claim 7 wherein said treated sheets is heat treated.

9. The panel of claim 7 wherein said treated sheets is coated.

10. The panel of claim 1 wherein said strips of each of the adjacent edges of said plates are bent inwardly toward said core, at least one said strip of one of said plates being bent about the strip of the other plate to lock said strips together, said strips being contained substantially between said first and second sheets.

11. The panel of claim 10 wherein at least one of said strips is bent so as to define a tear-shape in cross section.

12. The panel of claim 11 including flexible cylindrical means extending longitudinally in said tear-shape strip.

13. The panel of claim 10 wherein each of said strips are bent on a substantial radius at substantially right angles to said sheets and one of said strips is further bent to define a U-shaped, the other of said strips extending into and locked in said U-shape.

14. The panel of claim 13 wherein said U-shape strip and said other strip are stamped so as to define corresponding interlocking irregularities.

* * * * *

UNITED STATES PATENT AND TRADEMARK OFFICE

CERTIFICATE OF CORRECTION

PATENT NO. : 4,505,082

DATED : March 19, 1985

INVENTOR(S) : Peter Schmitz

It is certified that error appears in the above–identified patent and that said Letters Patent are hereby corrected as shown below:

Col. 1, Line 42: Change "of" first occurrence to --or--.
Col. 4, Line 53: Change "espcially" to --especially--.
Col. 6, Line 21: Change "sheets" to --sheet--.
Col. 6, Line 23: Change "sheets" to --sheet--.
Col. 6, Line 39: Change "U-shaped" to --U-shape--.

Signed and Sealed this

*Sixth* Day of *August 1985*

[SEAL]

*Attest:*

DONALD J. QUIGG

*Attesting Officer* *Acting Commissioner of Patents and Trademarks*